US008004385B2

(12) United States Patent
Kahr

(10) Patent No.: US 8,004,385 B2
(45) Date of Patent: Aug. 23, 2011

(54) ELECTRICAL PROTECTIVE DEVICE

(75) Inventor: Werner Kahr, Deutschlandsberg (AT)

(73) Assignee: EPCOS AG, Munich (DE)

( * ) Notice: Subject to any disclaimer, the term of this patent is extended or adjusted under 35 U.S.C. 154(b) by 0 days.

(21) Appl. No.: 12/717,853

(22) Filed: Mar. 4, 2010

(65) Prior Publication Data

US 2010/0207718 A1 Aug. 19, 2010

Related U.S. Application Data

(63) Continuation of application No. PCT/EP2008/060347, filed on Aug. 6, 2008.

(30) Foreign Application Priority Data

Sep. 6, 2007 (DE) ..... 10 2007 042 358

(51) Int. Cl.
*H01C 7/10* (2006.01)

(52) U.S. Cl. ..... 338/22 R; 338/236; 338/233

(58) Field of Classification Search ..... 338/22 R, 338/235–236, 232–233
See application file for complete search history.

(56) References Cited

U.S. PATENT DOCUMENTS

| | | | | |
|---|---|---|---|---|
| 3,750,081 | A * | 7/1973 | Miller | 338/174 |
| 3,750,082 | A | 7/1973 | Petersen et al. | |
| 5,140,298 | A * | 8/1992 | Gordon et al. | 338/226 |
| 5,142,265 | A | 8/1992 | Motoyoshi et al. | |
| 5,218,336 | A * | 6/1993 | Murakami | 338/328 |
| 5,663,861 | A * | 9/1997 | Reddy et al. | 361/106 |
| 5,798,685 | A * | 8/1998 | Katsuki et al. | 338/195 |
| 5,990,779 | A * | 11/1999 | Katsuki et al. | 338/232 |
| 6,542,066 | B1 | 4/2003 | Hasunuma et al. | |
| 6,922,131 | B2 * | 7/2005 | Walsh et al. | 337/167 |
| 2003/0218529 | A1 | 11/2003 | Hasunuma et al. | |
| 2006/0139831 | A1 | 6/2006 | Huemer et al. | |

FOREIGN PATENT DOCUMENTS

| | | | |
|---|---|---|---|
| DE | 102 43 113 | A1 | 4/2004 |
| EP | 1 026 705 | A1 | 8/2000 |

OTHER PUBLICATIONS

International Telecommunication Union, "Resistibility of Telecommunication Equipment Installed in a Telecommunications Centre to Overvoltages and Overcurrents," ITU-T, Jul. 2003, pp. 1-30, Recommendation K.20, International Telecommunications Union, Geneva, Switzerland.

* cited by examiner

*Primary Examiner* — Kyung Lee
(74) *Attorney, Agent, or Firm* — Slater & Matsil, L.L.P.

(57) ABSTRACT

An electrical protective device is described which has two PTC thermistor components which are in the form of plates and are arranged in a common housing. The housing in each case has an opening on two opposite sides, which opening corresponds to the dimensions of the PTC thermistor components such that the PTC thermistor components can be inserted into the housing through the openings. The two PTC thermistor components are electrically isolated from one another in the housing. The PTC thermistor components each have at least two connecting wires, by means of which the PTC thermistor components are locked to the housing.

20 Claims, 2 Drawing Sheets

ELECTRICAL PROTECTIVE DEVICE

This application is a continuation of co-pending International Application No. PCT/EP2008/060347, filed Aug. 6, 2008, which designated the United States and was not published in English, and which claims priority to German Application No. 10 2007 042 358.8 filed Sep. 6, 2007, both of which applications are incorporated herein by reference.

TECHNICAL FIELD

The invention relates to an electrical protective device.

BACKGROUND

The German patent publication DE 10243113 A1 discloses an electrical assembly which contains two thermistors and is used as a fault protection element in order to protect telephone lines.

SUMMARY

In one aspect, the invention specifies a protective device that can be produced cost-effectively and that complies with the requirements for telecommunications devices.

A protective device is specified that has two PTC thermistor components in the form of plates, wherein the PTC thermistor components are arranged in a common housing. The housing in each case has a cylindrical opening on two opposite sides. The size of the openings corresponds to the dimensions of the PTC thermistor components such that the PTC thermistor components can be inserted into the housing through the openings. The PTC thermistor components are arranged such that they are electrically isolated from one another in the housing. The two PTC thermistor components each include two connecting wires, by means of which the PTC thermistor components are locked in the housing.

The PTC thermistor components are arranged with the end surfaces facing one another in the housing. The PTC thermistor components preferably have a round base surface, although they may also have a rectangular shape or any other feasible shape as a base surface.

The PTC thermistor components are inserted through the openings into the housing, in such a way that the PTC thermistor components are fixed in the housing.

In one preferred embodiment, the housing is formed as one-piece. The protective device includes only a housing and two PTC thermistor components, which are inserted into the openings in the housing. This allows cost-effective production of the protective device, with only a small number of production steps being required.

The housing is preferably composed of an electrically insulating and temperature-resistant plastic.

In one preferred embodiment, the external dimensions of the housing project are only a few tenths of a millimeter beyond the dimensions of the PTC thermistor components. This makes it possible to provide an economic physical height, which is also low in comparison to the prior art. By way of example, if the PTC thermistor components have a plate diameter of 8 mm, this results in a physical height of about 8.5 mm.

The protective device preferably has an integral housing which is not provided with an additional cover. This allows the protective device to be produced cost-effectively.

The PTC thermistor components are preferably inserted at the side into the openings in the protective device, in which case the ends of the connecting wires of the PTC thermistor components just need to be bent around after insertion in order to ensure adequate fixing of the PTC thermistor components in the housing. In this case, there is no need for time-consuming and costly threading of the connecting wires into bushings which have to be provided additionally in the housing for this purpose, and in this case the separations required between the connecting contacts are achieved by the special physical shape of the housing.

The integral form of the housing makes it possible to achieve a low physical height for the protective device, which exceeds the dimensions of the PTC thermistor components that are used by only a few tenths of a millimeter.

The size of the openings in the housing is variable corresponding to the PTC thermistor components that are used, or can be adapted for the respectively used PTC thermistor components.

In one preferred embodiment, the PTC thermistor components are provided with connecting wires, and have electrical contact made with them, on opposite end surfaces. The connecting wires of the PTC thermistor components preferably run parallel to their end surfaces.

The PTC thermistor components preferably each have two connecting wires, which are arranged offset through 90°, on the opposite end faces. The connecting wires are preferably attached to the end faces of the PTC thermistor components at an angle of approximately 135° downwards with respect to the vertical.

The connecting wires of the PTC thermistor components are preferably angled through 135° parallel to the end surfaces of the PTC thermistor components, in the area of the wire center.

At the ends of the connecting wires, there is an area which is bent through about 90°. In one preferred embodiment, the ends of the connecting wires which are bent through 90° are used for locking the PTC thermistor components in the housing of the protective device. The connecting wires of the PTC thermistor components are therefore used both to make external contact and at the same time, by virtue of their special wire routing, for additional fixing of the PTC thermistor components in the housing. The PTC thermistor components are therefore locked in the openings in the housing not just by clamping, but additionally by means of their connecting wires, preferably on the lower face of the housing.

In one preferred embodiment, the housing has cutouts at the bottom in order to hold the connecting wires of the PTC thermistor components. In the area of the openings which are provided for the PTC thermistor components, the housing has areas which act as a stop during insertion of the PTC thermistor components into the openings, for the connecting wires of the PTC thermistor components which are arranged at the end in the direction of the housing interior and on the outward-facing end surfaces of the PTC thermistor components. The cylindrical openings in the housing, which are used to hold the PTC thermistor components, have cutouts on the downward-facing area which are used as a free space for the insertion of the connecting wires during insertion of the PTC thermistor components. The PTC thermistor components can be inserted with the connecting wires through the cylindrical holding opening, which is open at the bottom, in the housing, with the connecting wires then coming to rest on the stops, and with the ends of the connecting wires of the PTC thermistor components, which are then bent through 90°, being used for additional locking of the PTC thermistor components in the housing. Furthermore, the angled ends of the connecting wires of the PTC thermistor components are used to make electrical contact with the protective device. The angled ends of the connecting wires of the two PTC thermistor components are preferably arranged such that they are aligned to match a grid dimension of SMD connections.

The alignment of the ends of the connecting wires in accordance with the SMD arrangement allows the protective device to be integrated in any electrical circuit. The protective device is preferably used as a so-called Telecom Pair Protector, in which the protective device protects telecommunications devices against defects or a line failure caused by faults on the telephone line. Possible faults may be caused by overvoltages or currents being applied as a result of external events such as a lightning strike on the telephone line, or by induced overvoltages resulting from adjacent conductors carrying the main voltage, or as a consequence of lines touching.

In one embodiment, the PTC thermistor components are mounted in the opening in the housing by clamping, in which case the opening in the housing may have clamping ribs. In a further embodiment, the opening in the housing is provided in the outer area with a conical attachment or else an insertion incline, which makes it easier to insert the PTC thermistor components into the opening, while at the same time ensuring that the PTC thermistor components are adequately clamped in the opening.

The protective device is particularly suitable for use as a Telecom Pair Protector in telecommunications devices. The protective device complies with the ITU (International Telecommunication Union) safety regulations with regard to the safety regulations for telephone devices in ITU Standards T-K20 and K21, which means that the protective device is therefore suitable for the requirements and for the protective elements currently in use.

The PTC ceramics are electrically designed objectively, and all of the characteristics required for telecommunications protective devices are adjustable. If required, the size of the physical space can be adapted, provided that different plate diameters are used.

BRIEF DESCRIPTION OF THE DRAWINGS

The described features will be explained in more detail with reference to the following figures and exemplary embodiments.

The drawings which are described in the following text should not be considered to be true to scale. In fact, individual dimensions may be enlarged, reduced or else distorted, in order to illustrate them better.

Elements which resemble each other or which carry out the same function are annotated with the same reference symbols.

FIG. 1 shows a first embodiment of the protective device, in the form of a three-dimensional view from the front;

FIG. 2 shows a three-dimensional view of the protective device, viewed from the underneath;

FIG. 3 shows a schematic view of the lower face of a protective device; and

FIG. 4 shows a schematic view of a protective device from the front.

Figure 1:
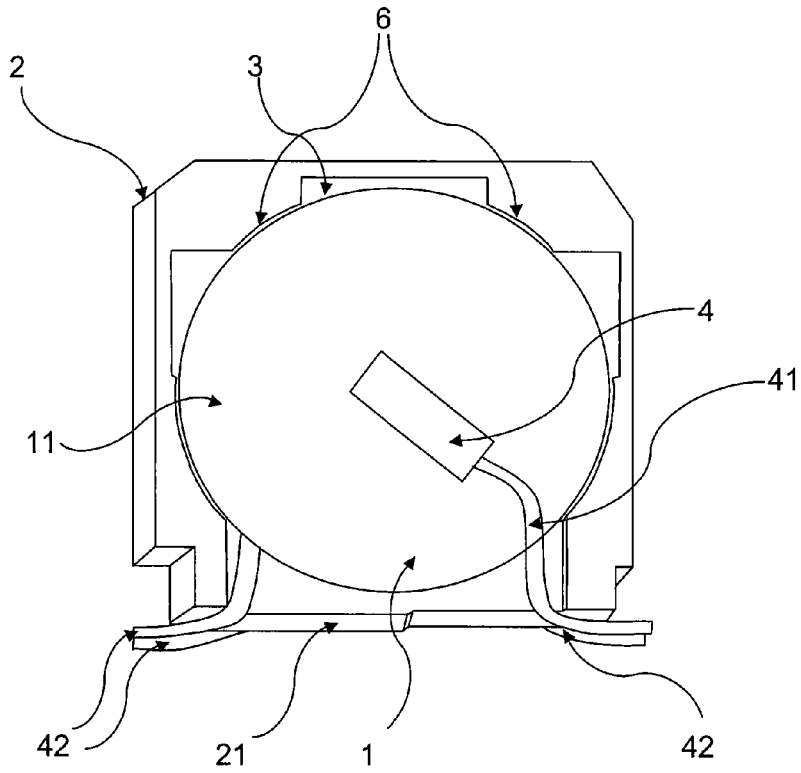

The following list of reference symbols may be used in conjunction with the drawings:

1 PTC thermistor component
11 End surface of the PTC thermistor component 1
2 Housing
21 Lower face of the housing 2
3 Opening
4 Connecting wire
41 Central area of the connecting wire 4
42 End of the connecting wire 4
5 Cutout
51 First step of the cutout 5
52 Second step of the cutout 5
6 Clamping ribs

DETAILED DESCRIPTION OF ILLUSTRATIVE EMBODIMENTS

FIG. 1 shows a first embodiment of the protective device, in the form of a three-dimensional view from the front, in which two PTC thermistor components 1 (one of which can be seen in the view of FIG. 1) are arranged in a common one-piece housing 2. The PTC thermistor components 1 are preferably arranged in openings 3 in the housing 2. The openings 3 in the housing 2 are preferably of a size which corresponds to the diameter of the PTC thermistor components 1. In the illustrated embodiment, the opening 3 has additional clamping ribs 6, which are used for clamping the PTC thermistor components 1 in the opening 3 in the housing 1. However, it is also possible for the opening 3 to be formed without clamping ribs 6, in which case the clamping is provided solely by the inner face of the opening 3 on the outer surface of the PTC thermistor components 1. The connecting wires 4 of the PTC thermistor components 1 in each case make electrical contact with the end surfaces 11 of the PTC thermistor components 1. The two connecting wires 4 of a PTC thermistor components 1 are each arranged parallel to the end surfaces 11, and offset through 90° with respect to one another. The central area 41, of the connecting wires 4 have an angle of 135°, with the connecting wires 4 running parallel to the end surfaces 11 of the PTC thermistor components 1. The ends 42 of the connecting wires 4 are bent through 90°, and are locked on the lower face 21 of the housing 2.

Figure 2:
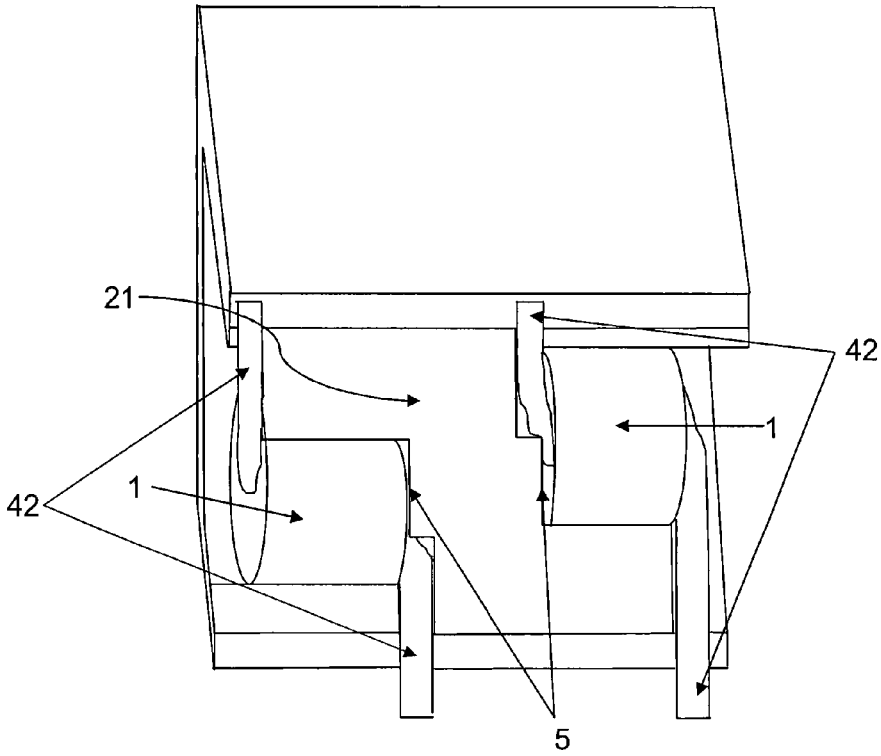

FIG. 2 shows a three-dimensional view of the protective device, viewed from underneath. Two PTC thermistor components 1 are arranged in the housing 2. The connecting wires 4 of the PTC thermistor components 1 are passed to the outside on the lower face 21 of the housing 2. On the lower face of the housing 2, the openings 3 have an area which is open at the bottom. The open area has step-like cutouts 5, in which the connecting wires 4 of the PTC thermistor components 1 are passed to the outside. The ends 42 of the connecting wires 4 are angled through 90° on the lower face, and are used to lock the PTC thermistor components 1 in the housing 2. The ends 42 of the connecting wires 4 are preferably at a predetermined distance apart, corresponding to a predetermined SMD grid dimension.

Figure 3:
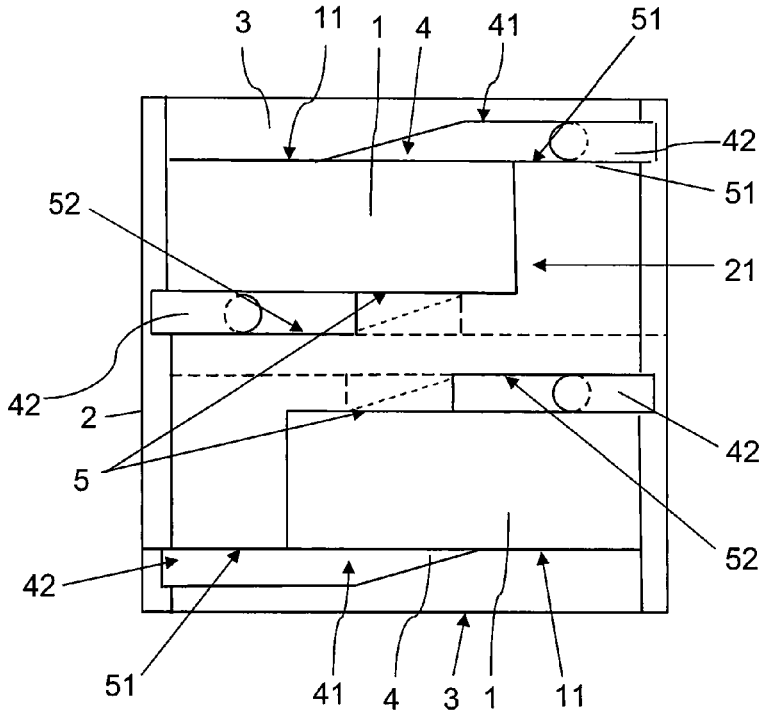

FIG. 3 shows a schematic view of the lower face of a protective device. The lower face 21 of the housing 2 has two openings 3 on two opposite faces. A PTC thermistor component 1 is arranged in each of the openings 3, having been inserted into the openings 3. The connecting wires 4 of the PTC thermistor components 1 point in the direction of the lower face 21 of the housing 2. The open area 5 has step-like cutouts 5, in which the connecting wires 4 of the PTC thermistor components 1 are passed to the outside. The openings 3 have cutouts 5 which are shaped such that, during insertion of the PTC thermistor components 1, the angled connecting wires 4 come to rest with the ends 42 in the two side cutouts 5. The ends 42 of the connecting wires 4 rest on the lower edge of the housing 2, such that the ends 42 of the connecting wires 4 ensure additional locking of the PTC thermistor components 1 in the housing 2.

The cutouts 5 preferably have a plurality of steps, with a first 51 and a second 52 of the steps of the cutouts 5 acting as a side boundary for the ends 42 of the connecting wires 4. The position of the first 51 and second 52 steps of the cutouts 5 at the same time ensures the positioning of the external contact of the protective device with predetermined SMD contacts. The ends 42 of the connecting wires 4 are therefore preferably at a predetermined distance apart, which would correspond to the SMD grid dimension. The protective device is therefore matched to a required SMD grid dimension by matching the first 51 and second 52 steps of the cutouts 5, by means of which the ends 42 of the connecting wires 4 are at least very largely fixed with their vertical separation. The ends 42 of the connecting wires 4 are bent through 90° on the lower face are used not only to make contact with the PTC thermistor components 1 from the outside but also for locking of the PTC thermistor components 1 in the housing 2.

Figure 4:
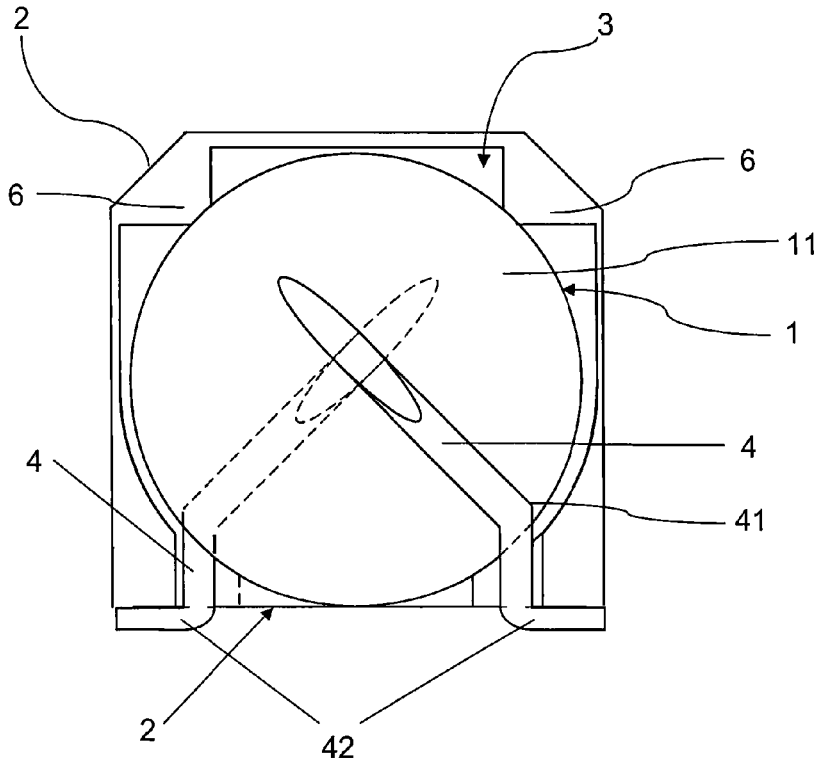

FIG. 4 shows a schematic view of a protective device from the front. A PTC thermistor component 1 is preferably arranged in each of the openings 3 in the housing 2, in a housing 2 which has two openings 3, of which only one opening 3 can be seen. The openings 3 in the housing 2 are preferably of a size which corresponds to the diameter of the PTC thermistor components 1. In the illustrated embodiment, the opening 3 has additional clamping ribs 6, which are used for clamping the PTC thermistor components 1 in the opening 3 in the housing 2. However, it is also possible for the opening not to have clamping ribs 6, in which case the clamping is provided solely by the inside of the opening 3 on the outer surface of the PTC thermistor components 1. The connecting wires 4 of the PTC thermistor components 1 each make electrical contact with the end surfaces 11 of the PTC thermistor components 1. The two connecting wires 4 of a PTC thermistor component 1 are each arranged parallel to the end surfaces 11, and are offset through 90° with respect to one another. The central areas 41 of each connecting wire 4 has a 135° angle parallel to the end surfaces 11 of the PTC thermistor components 1. The ends 42 of the connecting wires 4 are bent through 90°, and are locked on the lower face 21 of the housing.

Although it has been possible to describe only a limited number of possible developments of the invention in the exemplary embodiments, the invention is not restricted to them. In principle, it is possible to vary the size of the housing when different plate diameters are used.

The invention is not restricted to the illustrated number of elements.

The descriptions mentioned here are not restricted to the individual specific embodiments but, in fact, the features of the individual embodiments can be combined with one another as required, when technically worthwhile.

What is claimed is:

1. An electrical protective device, comprising:

two PTC thermistor components in the form of plates;

a common housing; and at least two connecting wires;

wherein the PTC thermistor components are arranged in the common housing;

wherein the housing has an opening on each of two opposite sides;

wherein the openings have a size that corresponds to dimensions of the PTC thermistor components such that the PTC thermistor components can be inserted into the housing through the openings;

wherein the PTC thermistor components are electrically isolated from one another in the housing; and wherein the PTC thermistor components are locked to the housing by the connecting wires.

2. The protective device according to claim 1, wherein the housing is a one-piece housing.

3. The protective device according to claim 1, wherein the housing comprises plastic.

4. The protective device according to claim 1, wherein external dimensions of the housing project only a few millimeters beyond the dimensions of the PTC thermistor components.

5. The protective device according to claim 1, wherein the PTC thermistor components make contact with connecting wires on two opposite base surfaces.

6. The protective device according to claim 1, wherein the two connecting wires arranged parallel to end faces on opposite end faces of the thermistor component, wherein the connecting wires are arranged offset through 90° with respect to one another.

7. The protective device according to claim 6, wherein the connecting wires are angled through 135° in a central area and parallel to the end surfaces of the PTC thermistor components.

8. The protective device according to claim 6, wherein the connecting wires of the PTC thermistor components are bent through 90° at their ends.

9. The protective device according to claim 8, wherein the ends of the connecting wires which are bent through 90° are used for locking the PTC thermistor components to the housing.

10. The protective device according to claim 1, wherein the housing has a plurality of cutouts on its lower face.

11. The protective device according to claim 10, wherein the cutouts hold the connecting wires of the PTC thermistor components.

12. The protective device according to claim 1, wherein the PTC thermistor components are mounted in the openings in the housing by clamping.

13. The protective device according to claim 1, wherein the openings in the housing have clamping ribs.

14. The protective device according to claim 1, wherein the openings in the housing have a conical attachment in an outer area.

15. The protective device according to claim 1, wherein the PTC thermistor components have a rectangular base surface.

16. The protective device according to claim 1, wherein the PTC thermistor components have a round base surface.

17. The protective device according to claim 1, wherein the protective device suitable for use in a telecommunications device.

18. An electrical protective device, comprising:

a housing having a first opening at one side of the housing and a second opening at an opposite side of the housing;

first and second PTC thermistor components arranged in the housing, dimensions of each PTC thermistor component corresponding to the size of a corresponding opening such that the PTC thermistor components can be inserted into the housing through the openings, wherein the PTC thermistor components are electrically isolated from one another in the housing;

a first connecting wire arranged adjacent the first opening and a second connecting wire arranged adjacent the second opening, the PTC thermistor components being locked to the housing by the connecting wires.

19. The protective device according to claim 18, wherein the connecting wires are each arranged parallel to an end face of a corresponding PTC thermistor component, the first connecting wire being arranged offset through 90° with respect to the second connecting wire.

20. The protective device according to claim 19, wherein each connecting wire is angled through 135° in a central area.

* * * * *